United States Patent [19]

Larson et al.

[11] Patent Number: 4,907,433

[45] Date of Patent: Mar. 13, 1990

[54] APPARATUS AND METHOD FOR ADAPTIVE CONTROL OF A ROLLING MILL

[75] Inventors: Duane B. Larson; Nick Korzow, Jr., both of Valparaiso, Ind.

[73] Assignee: Bethlehem Steel Corporation, Bethlehem, Pa.

[21] Appl. No.: 182,521

[22] Filed: Apr. 18, 1988

[51] Int. Cl.[4] ..... B21B 37/12

[52] U.S. Cl. ..... 72/8; 72/11; 72/37; 72/42; 72/71; 72/205; 72/249

[58] Field of Search ..... 72/8, 16, 11, 20, 37, 72/42, 243, 245, 249

[56] References Cited

U.S. PATENT DOCUMENTS

| | | | |
|---|---|---|---|
| 4,361,063 | 11/1962 | Larson | 83/71 |
| 4,414,832 | 11/1983 | Brenneman et al. | 72/8 |
| 4,464,959 | 8/1984 | Larson | 83/37 |
| 4,478,119 | 10/1984 | Larson | 83/42 |
| 4,576,027 | 3/1986 | Yoshida et al. | 72/11 |
| 4,625,536 | 12/1986 | Morooka | 72/249 |
| 4,665,729 | 5/1987 | Koyama et al. | 72/8 |
| 4,674,313 | 6/1987 | Bald et al. | 72/249 |

FOREIGN PATENT DOCUMENTS

| | | | |
|---|---|---|---|
| 121813 | 7/1982 | Japan | 72/8 |
| 39412 | 3/1984 | Japan | 72/8 |
| 120311 | 7/1984 | Japan | 72/8 |
| 51923 | 11/1985 | Japan | 72/8 |
| 2137778 | 10/1984 | United Kingdom | 72/8 |

*Primary Examiner*—W. Donald Bray

*Attorney, Agent, or Firm*—Shlesinger & Myers

[57] ABSTRACT

The method of controlling a velocity dependent factor of strip material being processed in a mill includes the steps of simultaneously determining the apparent velocity of material prior to, between and subsequent to spaced apart work rolls. Input slip is determined by comparing the apparent input velocity with the apparent work roll velocity, and output slip is determined by comparing the apparent output velocity with the apparent work roll velocity. A velocity dependent factor is calculated in response to a comparison of input slip and output slip. The calculated factor is compared with a previously calculated factor and a derived factor is calculated when the calculated factor exceeds the previously calculated factor by more than the selected amount and an adaptive factor used to calculate the derived factor is calculated when the calculated factor does not exceed the previously calculated factor by the selected amount. A selected number of the calculated and/or derived factors are averaged and the divergence between the averaged factor and a target factor is used to adjust the spacing between the work rolls.

29 Claims, 5 Drawing Sheets

APPARATUS AND METHOD FOR ADAPTIVE CONTROL OF A ROLLING MILL

BACKGROUND OF THE INVENTION

Temper rolling of steel strip material is used to regulate the mechanical and stiffness properties thereof. Temper rolling results in cold working of the strip material, and is achieved by passing the material through spaced rotating rolls in order to reduce the thickness while maintaining the width essentially constant. The increase in length brought about by reduction in thickness is known as extension, and is one criterion used for determining the relative reduction in thickness.

A tempering mill normally has an input for supplying coiled strip material, spaced apart rotatable work rolls, and an exit or take-up coiling assembly on which the finished product is wound. Control of the extension throughout the length of the strip material is important in order to assure that uniform properties are present. Differential variations in the extension throughout the length of the material can result in unusable product, or product which must be diverted for further processing or the like. One contributor to non-uniform extension is the slip which may occur while the material is being fed through the mill. Although the causes of slip are numerous, good mill control requires that slip be controlled or taken into account, regardless of its source.

The finite length of a coil requires that the mill accelerate the strip material once the coil is loaded, and decelerate the coil after processing is completed. The acceleration and deceleration ranges can occur over a relatively substantial length of the strip material, and it is important that slip be controlled during the acceleration and deceleration phases in order to maximize the percentage of finished material having proper parameters. Should the differential extension during the acceleration and deceleration phases not fall within appropriate ranges, then that material may need to be discarded or further processed.

As noted, the causes of slip are many and it is important that the slip be controlled or taken into account. It is also important that the control system be able to recognize spurious or momentary changes in extension. Should spurious signals not be recognized, then reaction to them could well cause further inaccuracies and result in los of product.

An adaptive control system is one which takes into account the divergence of an achieved result from the expected result. The system adapts to the divergence as a means for compensating for deviation from the expected. Position control may be utilized when the divergence from the desired is fixed, whereas integral control may be used when an average divergence from the desired is known. A combination of integral and position control is one method of assuring that a system is driven toward the desired result.

The disclosed invention is an adaptive control system and method which is advantageously utilized for regulating and controlling extension in a tempering mill. The system continuously monitors the differential extension of the strip material and compares an averaged extension with the aim or target extension as a means for determining the adjustments required. Nine bands of control are provided for driving the averaged extension toward the targeted extension, and each band of control drives the extension toward the target extension with a different degree of intensity. The system includes means for recognizing spurious signals or temporary divergences and disregards those. While the invention is disclosed as utilized with a temperinq mill, those skilled in the art will understand that it may be applied to other mills, both steel and non-steel, wherein slip or some other velocity dependent factor needs to be regulated and controlled.

OBJECTS AND SUMMARY OF THE INVENTION

The primary object of the disclosed invention is an adaptive control system and method which continuously regulates a velocity dependent processing variable while assuring that spurious signals and temporary divergences are disregarded.

An apparatus for regulating the operation of a rolling mill having a material input, opposed work rolls and means for adjusting the spacing between the work rolls, and a material output comprises velocity determining means for simultaneously determining the velocity of the material prior to, when between and subsequent to the work rolls. Slip determining means are operably associated with the velocity determining means for detecting input slip by comparing the speed of the material prior to and when between the work rolls, and for detecting output slip by comparing the speed of the material subsequent to and when between the work rolls. First means are operably associated with the slip determining means for calculating the velocity dependent factor when input slip exceeds output slip, and for calculating a first derived factor when the calculated factor exceeds a previously calculated factor by more than a selected amount and for calculating a first adaptive parameter used to calculate the first derived factor when the calculated factor is less than the previously calculated factor by less than a selected amount. Second means are operably associated with the slip determining means for calculating the velocity dependent factor when the output slip exceeds the input slip, and for calculating a second derived factor when the calculated factor exceeds the previously calculated factor by more than a selected amount and for calculating a second adaptive parameter used for calculating the second derived factor when the calculated velocity dependent factor is less than the previously calculated factor by less than the selected amount. Averaging means are operably associated with the first and second means for calculating an averaged velocity dependent factor from a selected number of the calculated and/or derived factors. Error determining means are operably associated with the averaging means for computing an error factor by comparing the averaged velocity factor with the target factor. A control means is operably associated with the error determining means and is for operable association with the adjusting means for causing the spacing between the work rolls to be regulated in response to the error factor.

The method of controlling a velocity dependent factor of strip material being processed in a mill having an input assembly supplying material to be processed, spaced work rolls for processing the material, means for adjusting the spacing between the work rolls, and an output assembly for removing processed material comprises the steps of simultaneously determining the apparent velocity of the material prior to, between and subsequent to the work rolls. Input slip is determined by comparing the apparent input velocity with the apparent work roll velocity and output slip is determined by comparing the apparent output velocity with the apparent work roll velocity. A velocity dependent factor is calculated in response to a comparison of input slip and output slip. The calculated factor is compared with a previously calculated factor and a derived factor is calculated when the calculated factor exceeds the previously calculated factor by more than a selected amount, and an adaptive factor used to calculate the derived factor is calculated when the calculated factor does not exceed the previously calculated factor by the selected amount. A selected number of the calculated and/or derived factors are averaged and the divergence thereof with a target factor is determined. The spacing between the work rolls is adjusted in response to the divergence of the averaged factor with the target factor.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
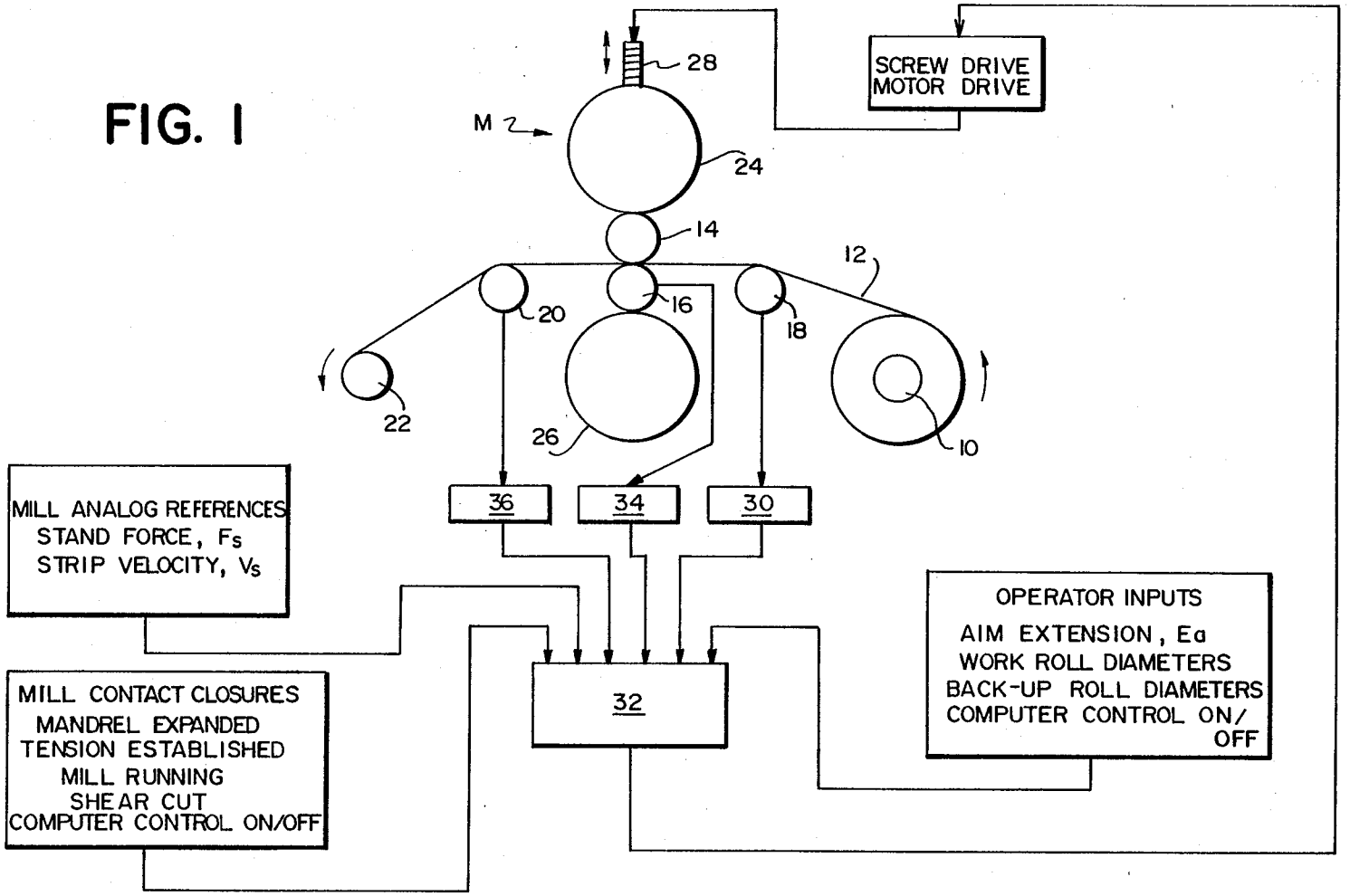
FIG. 1 is a schematic view illustrating a one stand tempering mill pursuant to the invention.

Payoff reel 10 feeds coiled strip material 12 through mill M, as best shown in FIG. 1. Spaced work rolls 14 and 16 are downstream of input measuring roll 18 over which roll the strip material 12 passes prior to being fed between the work rolls 14 and 16. Output measuring roll 20 is downstream of work rolls 14 and 16, and directs the finished strip material 12 to exit reel 22 on which the material is coiled.

Back-up rolls 24 and 26 are engaged with work rolls 14 and 16, respectively, as a means for stabilizing the work rolls 14 and 16 as they rotate during processing of strip material 12. Screw drive 28 is engaged with back-up roll 24 in order to apply force to same, for thereby causing the position adjustable work roll 14 to approach or move away from the work roll 16. In this way, application of a voltage signal to the screw drive motor drive causes operation of the screw drive 28, and thereby regulation of the spacing between the work rolls 14 and 16.

Tachometer 30 is operably associated with input measuring roll 18 and with controller 32 in order to permit the controller 32 to determine the rotational velocity of the input measuring roll 18, and thereby the apparent velocity of the strip material 12 moving therewith. A similar tachometer 34 is operably associated with the stand or work roll 16 and with the controller 32 in order to likewise provide information concerning the rotational velocity of the stand roll 16. Lastly, a further tachometer 36 is operably associated with the output measuring roll 20 and with the controller 32 so that the rotational velocity of the output measuring roll 20 can be determined. In this way, the controller 32 can essentially simultaneously monitor the velocity of the rolls 18, 16 and 20, and thereby determine the apparent velocity of the strip material 12 prior to, when between and subsequent to the spaced work rolls 14 and 16.

FIG. 1 also discloses the mill analog references, mill contact closures and the operator inputs which are supplied to the controller 32 in order to permit the mill M to be operated. It can be noted that the analog references include stand force, $F_S$, and strip velocity, $V_S$. The mill contact closures provide information concerning whether the mandrel has expanded, whether tension has been established, whether the mill is running, whether the shear has cut the finished material and whether the computer or controller is in the on or off mode. The operator inputs, on the other hand, include the aim or target extension Ea, the diameters of the work rolls 14 and 16, the diameters of the back-up rolls 24 and 26, as well as an indication of whether the computer or controller 32 is operating.

When the strip material 12 is first fed into the mill M, then the wrap angle around the input measuring roll 18 is the smallest because the diameter of the coil on payoff reel 10 is the largest. This relatively small wrap angle permits slip to occur between the input measuring roll 18 and the strip 12. Thus, calculation of extension with information provided by roll 18 must take the coil diameter into account, and must furthermore take into account the reduction in the diameter of the coil on the payoff reel 10 as the material is unwound. Similar concerns relate to exit reel 22 as the processed material is wound. In that case, however, the wrap angle is the greatest as coiling commences and decreases as coiling proceeds. Should a bridle roll be used in place of output roll 20, then this produces a relatively large wrap angle. Other factors which must be taken into account as processing proceeds are gauge, tension, oil, speed, random perturbations and roll crown. These factors, as well as others, can cause slip to arise and this slip must be controlled or taken into account if a meaningful extension measurement is to be made.

Extension is defined as the change in length, with width held constant, experienced by a section of the strip 12 as it proceeds through the mill M. The length of the strip considered is from the input measuring roll 18 to the output measuring roll 20. If DL1 is defined as the length of strip passing over the input measuring roll 18 for unit time DT and DL2 as the length of strip 12 passing over the output measuring roll 20 for the same unit time DT, then the percentage extension occurring from input measuring roll 18 to output measuring roll 20 in time DT is:

$$E1=((DL2-DL1)/DL1)\times 100.$$

This equation is appropriate for calculating extension, providing that minimal slip occurs between the input measuring roll 18 and the strip 12. Should the slip become excessive, then extension may be defined with reference to output roll 20 as:

$$E2=((DL2-DL1)/DL2)\times 100.$$

The extension per unit time, when DT approaches 0, is therefore given by:

$$E1=((v_2-v_1)/v_1)\times 100$$

and $$E2=((v_2-v_1)/v_2)\times 100.$$

In a tempering mill, the strip exit speed v2 is essentially equal to the stand speed vs, so that slip can be calculated as:

$$S2=|(v2-vs)/vs|\times 100$$

and, $$S1=||(vs-v1)/vs|\times 100-E_n|.$$

En is the latest extension calculated and is subtracted from $|(vs-v1)/vs|\times 100$ because En is approximately equal to $|(vs-v1)/vs|\times 100$. Thus the above equation for S1 gives a meaningful percentage measure of the input measuring roll slip.

Input 18 and output 20 measuring rolls not only experience errors due to slip, but random perturbations frequently occur from various sources; such as, backlash in gears and linkage, variations in strip gauge, mechanical vibrations, etc. It is necessary that these random perturbations be filtered out for the control system to accurately compare the extension calculated at time step n with the extension calculated at time step n−1.

Figure 5:
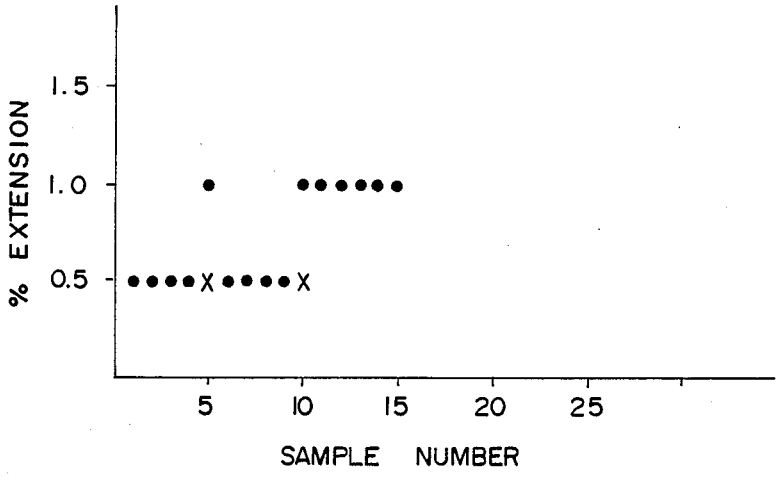

FIG. 5 is a graph illustrating percentage extension versus sample number. It can be noted that the percentage extension for samples 1 through 4 remains constant at 0.5%. A perturbation up to 1.0% occurs at sample number 5, and the percentage extension then remains constant through sample 9. Once again, at sample 10 there is an apparent perturbation of extension to 1.0%, after which the percentage extension remains constant at 1.0%. It is important that the control system recognize when the percentage extension is operating on a plateau, and when the plateau has changed.

We have found that random perturbation occur most frequently during the acceleration and deceleration stages, and it is therefore necessary for the system to recognize when apparent perturbations represent changes in the true measurement of extension. Random perturbations can be identified by comparing the calculated extension En, calculated pursuant to the above equations for E1 or E2, with the immediately preceding calculated extension En−1. Which extension equation to use is based upon the differences between input slip Sl and output slip S2. Should the next subsequent calculated extension, En+1, substantially correspond with that previously calculated, En, then the system recognizes the establishment of a new plateau and appropriately adjusts all relevant parameters. Should only one apparently random perturbation b detected, then this is ignored and the control system derives what the extension En should be, and thereby avoids reaction to apparent changes.

We have found that perturbations can be eliminated through use of an alqorithm which takes into account the slip at both the input and the output measuring rolls. Should input slip be less than output slip, then En is calculated as $(v2/v1-1)\times 100$. After En is calculated, then the absolute value of En - En−1 is checked as to whether it is less than or equal to some percentage of En−1. If the absolute value is less than the selected percentage, thereby failing to indicate a perturbation, then an adaptive factor is calculated pursuant to:

$$\beta=v2/vs$$

Should the absolute value be greater than the desired percentage of En−1, thereby indicating an apparent perturbation, then an apparent or derived extension is calculated pursuant to:

$$En=(\beta vs/v1-100)\times 100$$

And this derived factor is saved and replaces the calculated factor when adjustment of the work rolls is considered.

Should the input slip exceed or be equal to output slip, then extension is calculated as:

$$En=(1-v2/v2)\times 100.$$

Should the absolute value of En - En−1 be less than or equal to some constant times En−1, then an adaptive parameter is calculated pursuant to:

$$\alpha=v1/vs$$

Should the absolute value exceed the selected percentage of En−1, then the apparent or derived extension is calculated pursuant to:

$$En=(1-\alpha vs/v2)\times 100$$

and this value is saved and substituted for the calculated extension when adjustment of the work rolls is now considered.

It should be noted that the above perturbation identification and elimination method assumes a linear relationship between input velocity and stand velocity. The method furthermore assumes a linear relationship between output velocity and stand velocity. This is necessary because the adaptive parameters relate the input and output velocity to the stand velocity and are based upon previous and present calculations. These adaptive parameters will vary from coil to coil, and even during the coiling process itself.

We have found that the calculation of an averaged extension factor may be used by the control system to approximate both position and integral control. The averaged extension factor is calculated pursuant to the equation:

$$\overline{En} = 1/n \sum_{i=1}^{n} E_i, \text{ where } 1 \leqq n \leqq NAV.$$

The averaged extension is based upon an essentially randomly selected number of previously calculated and/or derived extensions. We have found that when the average is calculated from only one extension, then position control is achieved. When the averaged extension is calculated from more than one extension previously calculated and/or derived, then integral control is achieved. The use of the randomly selected number n for calculating the averaged extension provides the benefits of both position and integral control, and avoids the need for separate control schemes to achieve both.

As previously noted, a voltage signal, Vrn, is applied to the screw drive motor drive of FIG. 1 in order to cause operation of the screw drive 28 for regulating the spacing between the work rolls 14 and 16. Should an overshoot or undershoot occur, then the adaptive techniques of the system modify the control equation in order to compensate for this deviation. We have found that nine bands of control provide best results for causing the work rolls to be adjusted in a manner which drives the averaged extension towards the aim extension.

We have found that, when the averaged extension exceeds the target extension, then the following control equations and boundaries as set out in Table 1 apply:

TABLE 1

| Region | Equation | Boundaries |
|---|---|---|
| Maximum | $Vrn = Vn$ | $Ea < (\overline{En} - Ea)$ |
| Forcing | $Vrn = Vn((\overline{En} - Ea)/Ea)$ | $0.3\ Ea < (\overline{En} - Ea) \leqq Ea$ |
| Adaptive | $Vrn = Vr(n-1) - Vn((\overline{En} - \overline{En} - 1)/Ea)\beta$ up | $0.15\ Ea < (\overline{En} - Ea) \leqq 0.3Ea$ |
| Toggle | $Vrn = \alpha_T Vn$ | $0.3 + .01Ea < (\overline{En} - Ea) \leqq .15Ea$ |

In the dead band, or that area where averaged extension equals target extension, then the voltage reference signal equals 0 and the bounoary is: $-0.03-0.01Ea<(\overline{En}-Ea)\leqq 0.03+0.01Ea$.

In the situation where the averaged extension is less than the aim extension, then Table 2 sets out the appropriate considerations.

TABLE 2

| Region | Equation | Boundaries |
|---|---|---|
| Toggle | $Vrn = \alpha_T Vn$ | $-.15Ea < (\overline{En} - Ea) \leqq -.03-.01Ea$ |
| Adaptive | $Vrn = Vr(n-1) - Vn((\overline{En} - \overline{En} - 1$ | $-.3Ea < (\overline{En} - Ea) \leqq -.15Ea$ |
| Forcing | $Vrn = Vn((\overline{En} - Ea)/Ea)$ | $(\leqq \overline{En} - Ea) \leqq -.3Ea$ |
| Maximum | $Vrn = -Vn$ | $(\leqq -Ea) \leqq 0$ |

In the above equations, Vrn=voltage at time. n; Vn=volt used to drive the screw 28 at maximum;

$$\overline{En} = 1/n \sum_{i=1}^{n} E_i$$

where $2 \leqq n \leqq NAV, \alpha_T$ is a software adjustable constant and $\beta$ up, $\beta$ dn are adaptive parameters.

The above indicates that a closed loop control scheme is utilized in regulating the spacing between the work rolls 14 and 16 as the averaged extension is driven toward the aim extension. We have found that best results are achieved when the screw drive 28 maintains the spacing between the rolls 14 and 16 in a constant state of flux. This is because it is easier to move a moving body than it is to start a body at rest into motion. For this reason, the dead band region is very narrow, and there is little tendency for the upper work roll 14 to remain fixed in position. Naturally, the changes in the dead band are very slight.

Those skilled in the art will understand that the adaptive region is most active in driving the averaged extension toward the aim extension, particularly during the acceleration and deceleration phases. The adaptive voltage equation initializes $\beta$ up equal to 1.0, and then increases up by increments of $\Delta\beta$ up=0.1 each time no overshoot occurs. This has the effect of driving the extension toward the aim extension faster. Should an overshoot occur, then $\beta$ up is reduced by increments of $\beta$ up=0.1. This has the effect of driving the extension toward the aim extension slower the next time the calculated extension is used for control. For $(\overline{En}-Ea)<0$ (Table 2),the same logic is used for $\beta$ dn.

The screw drive 28 is a mechanical device and a bumping or toggling process is used in adjusting the spacing between rolls 14 and 16. This has the effect of tapping the screw drive 28 toward the dead band. The toggle reference depends on mechanical mill responses. A software adjustable constant is used to determine the proper magnitude of the reference voltage signal. The toggle and dead band regions are dependent upon the resolution of the tachometers used.

The maximum and forcing region voltage equations are used when the averaged extension has a substantial deviation from the aim extension. They cause the rolls to be driven with much more intensity because the divergence is so large. This is because great accuracy is required when averaged extension is relatively close to aim extension, but that such accuracy is not necessary when the divergence is so large.

Figure 2:
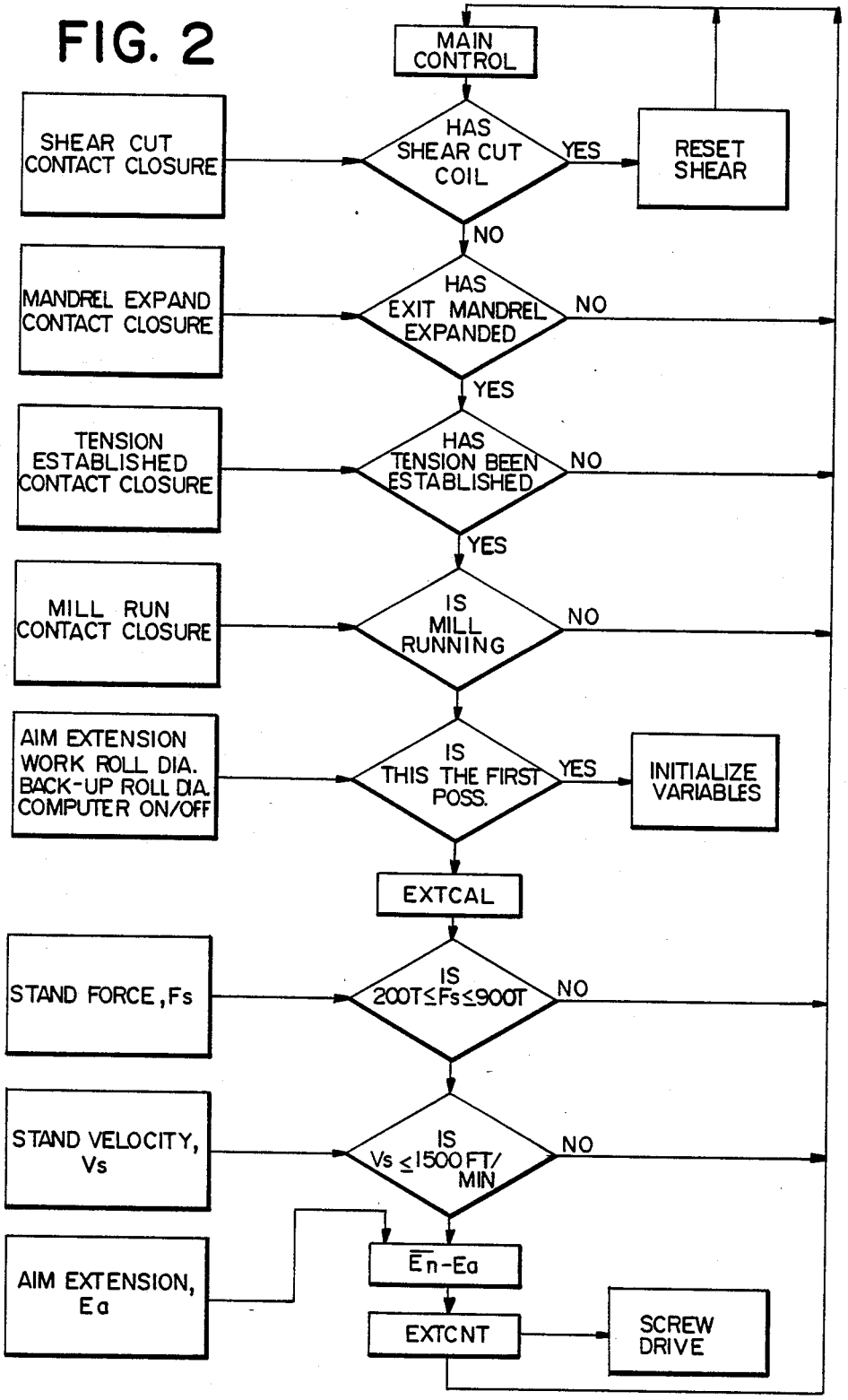
FIG. 2 is a flow chart illustrating a portion of the algorithm used to control the mill of FIG. 1.

FIG. 2 discloses a portion of the algorithm used in operating the mill M pursuant to the invention. Initially, reference is made as to whether the main control has been initialized. The alqorithm then determines whether the shear has cut the coil based upon a signal from the shear cut contact closure. Should the shear have cut the coil, then the shear is reset. Should the shear not have cut the coil, then the algorithm determines whether the exit mandrel has expanded in view of the signal sent by the mandrel expand contact closure. Should the exit mandrel have expanded, then the algorithm determines whether tension has been established in view of the signal transmitted by the tension established contact closure. The algorithm next determines whether the mill is running in view of the mill run contact closure, and finally determines whether this is the first pass for this particular length of strip material. Should this be the first pass, then the variables, such as aim extension, work roll diameter, back-up roll diameter and the like, are initialized because they may differ from those of the previous coil. If it is not the first pass, then the average-dextension is calculated pursuant to that portion of the algorithm on FIG. 3.

Figure 3:
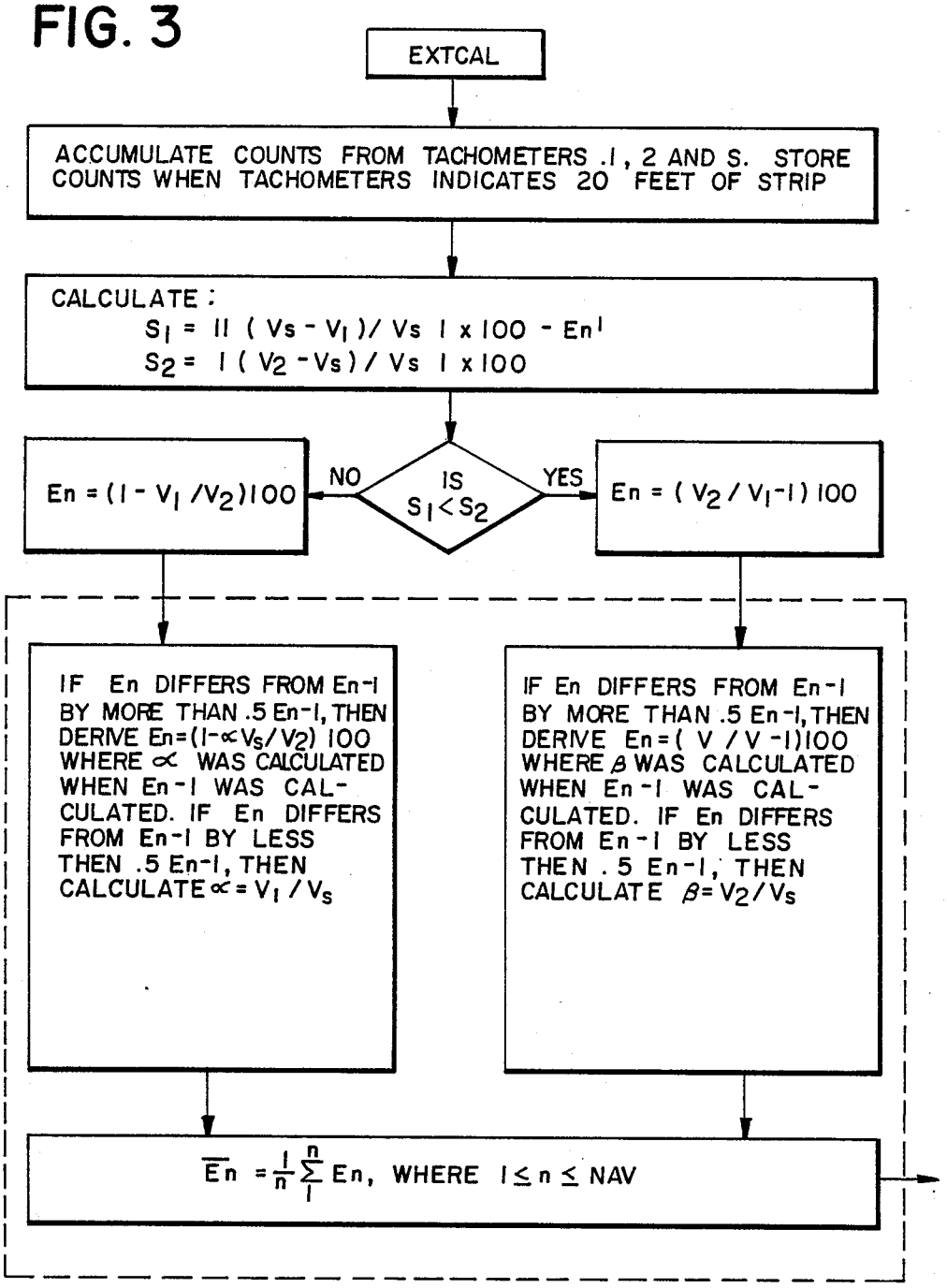
FIG. 3 is a further portion of the algorithm illustrating the method of determining the averaged velocity dependent factor.

EXTCAL, that portion of the algorithm of FIG. 3, first accumulates sufficient counts from the tachometers 30, 34 and 36 to determine whether 20 feet of strip material have passed. Once that has occurred, then input slip and output slip are calculated pursuant to the previously developed equations. The algorithm then queries whether input slip is less than output slip. If it is, then extension is calculated as:

$$En=(V2/V1-1)\ 100.$$

The algorithm then determines whether the calculated extension differs from that calculated with the immediately precedent sample, En−1. Should the calculated extension exceed En−1 by more than 50%, thereby indicating a perturbation, then the derived extension is calculated as:

$$En=(\beta Vs/V1-1)\ 100,$$ where $\beta$ was calculated when En−1 was calculated. Should En differ from En−1 by less than 50%, then the adaptive parameter is calculated pursuant to: $\beta=V2/Vs$.

Should input slip not be less than output slip, then extension is calculated pursuant to: $En=(1-V1/v2)\ 100$. The algorithm then determines whether the calculated extension differs from En−1 by more than 50%. Should it do so, then the derived extension is calculated pursuant to: $En=(-\beta Vs/V2)\ 100$, where $\beta$ was calculated when En−1 was calculated. Should the calculated extension differ from En−1 by less than 50%, then the adaptive parameter is calculated pursuant to: $\alpha=V1/Vs$.

The algorithm next calculates the averaged extension, $\overline{En}$, pursuant to the previously derived equation therefor. We have found that the averaged extension should be calculated from as many as five samples, and that the number of samples used to calculate the extension should be pursuant to a pseudo-random selection process in order to obtain the benefits of position and integral control. Such may be integrated through a do-loop or the like. Also, the average could, naturally, be developed from more than five samples in certain instances.

Once the averaged extension $\overline{En}$ is calculated, then the algorithm of FIG. 2 determines whether the stand force Fs is within the appropriate range. Assuming that it is, then the algorithm determines whether the stand velocity Vs is within the proper range. Assuming that it is, then the aim extension Ea is referenced, and that portion of the algorithm of FIG. 4 is used to determine the adjustment, if any, required of the screw drive 28.

Figure 4:
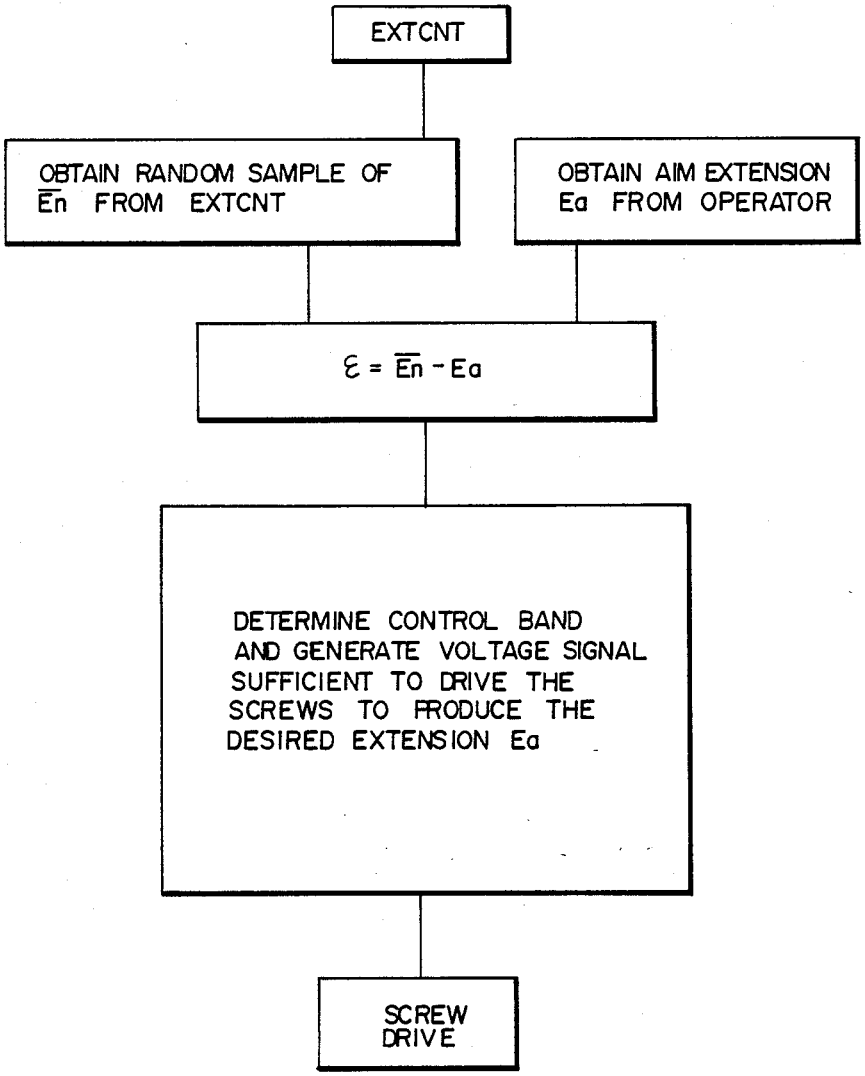
FIG. 4 is yet a further portion of the algorithm illustrating the error determination function; and, FIG. 5 is a graph illustrating the results of the spurious signal recognition function achieved by the invention.

EXTCNT of FIG. 4 first obtains the random sample of averaged extension $\overline{En}$ from EXTCAL of FIG. 3. Similarly, the aim extension Ea is referenced. The algorithm then computes the error or divergence of the averaged extension $\overline{En}$ from the aim extension Ea. Once the divergence is established, then the appropriate band of control is selected pursuant to Tables 1 and 2, and the voltage signal generated pursuant thereto. The screw drive 28 is then appropriately adjusted through its screw drive motor control.

We have compared results of the disclosed development with the previous mechanisms used in the temper mill. We have found that the disclosed extension measurement and control system extends the acceleration and deceleration regions of measurement by at least 25%, because the control system extracts an accurate measure of extension in the noisy mill environment of acceleration, deceleration, slipping rolls, and mechanical perturbations. Furthermore, the invention has higher extension in the acceleration and deceleration regions, while the mean error and standard deviation thereof are substantially reduced.

While this invention has been described as having a preferred design, it is understood that it is capable of further modifications, uses and/or adaptations of the invention following in general the principle of the invention and including such departures from the present disclosure as come within the known or customary practice in the art to which the invention pertains, and as may be applied to the essential features set forth and fall within the scope of the invention and the limits of the appended claims.

What we claim is:

1. Apparatus for regulating the operation of a rolling mill having a material input, opposed work rolls and means for adjusting the spacing between the work rolls, and a material output, the apparatus comprising:

(a) velocity determining means for simultaneously determining the velocity of the material prior to, when between and subsequent to the work rolls;

(b) slip determining means operably associated with said velocity determining means for detecting input slip by comparing the speed of the material prior to and when between the work rolls and for detecting output slip by comparing the speed of the material subsequent to and when between the work rolls;

(c) first means operably associated with said slip determining means for calculating a velocity dependent factor when input slip exceeds output slip and for calculating a first derived factor when the calculated factor exceeds a previously calculated factor by more than the selected amount and for calculating a first adaptive parameter used to calculate the first derived factor when the calculated factor is less than the previously calculated factor by less than a selected amount;

(d) second means operably associated with said slip determining means for calculating the velocity dependent factor when the output slip exceeds input slip and for calculating a second derived factor when the calculated factor exceeds the previously calculated factor by more than a selected amount and for calculating a second adaptive parameter used for calculating the second derived factor when the calculated velocity dependent factor is less than the previously calculated factor by less than the selected amount;

(e) averaging means operably associate with said first and second means for calculating an averaged velocity dependent factor from a selected number of the calculated and/or derived factors;

(f) error determining means operably associated with said averaging means for computing an error factor by comparing the averaged velocity factor with a target factor; and, (g) control means operably associated with said error determining means and for operable association with the adjusting means for causing the spacing between the work rolls to be regulated in response to the error factor.

2. The apparatus of claim 1, wherein:

(a) said velocity determining means includes a tachometer.

3. The apparatus of claim 2, wherein:

(a) said slip determining means includes an input roll and an output roll, each of said rolls being operably associated with a tachometer.

4. The apparatus of claim 1, wherein:

(a) said averaging means includes means for generating the number of calculated and/or derived factors used in calculating the average velocity dependent factor.

5. The apparatus of claim 1, wherein:

(a) said first and second means velocity dependent factors include the percentage extension of the material passing between the work rolls.

6. The apparatus of claim 1, wherein:

(a) said first means first derived factor is based upon the ratio of the velocity of the material when between and subsequent to the work rolls; and, (b) said second means second derived factor is based upon the ratio of the velocity of the material when between and prior to the work rolls.

7. The apparatus of claim 6, wherein:

(a) said second adaptive parameter is proportional to the ratio of the material velocity subsequent to and when between the work rolls; and, (b) said first adaptive parameter is proportional to the ratio of the material velocity prior to and when between the work rolls.

8. A rolling mill for controllinq a velocity dependent factor of strip material being processed in the mill, comprising:

(a) input means for supplying strip material;

(b) first and second spaced work rolls downstream of said input means for processing strip material passing therebetween;

(c) means for adjusting the spacing between said work rolls;

(d) output means downstream of said work rolls for removing processed material;

(e) first tachometer means operably associated with said input means for determining the apparent velocity of the material thereat, second tachometer means operably associated With one of said work rolls for determining the apparent velocity of the material passing between said work rolls, and third tachometer means operably associated with said output means for determining the apparent velocity of the material thereat;

(f) slip determining means operably associated with said first, second and third tachometer means for determining input slip by comparing the apparent input velocity with the apparent work roll velocity and for determining output slip by comparing the apparent output velocity with the apparent work roll velocity;

(g) first means operably associated with said slip determining means for calculating a velocity dependent factor when input slip exceeds output slip and for calculating a first derived factor when the calculated factor exceeds a previously calculated factor by more than the selected amount and for calculating a first adaptive parameter used to calculate the first derived factor when the calculated factor is less than the previously calculated factor by less than the selected amount;

(h) second means operably associated with said slip determining means for calculating the velocity dependent factor when the output slip exceeds or is equal to the input slip and for calculating a second derived factor when the calculated factor exceeds the previously calculated factor by more than a selected amount and for calculating a second adaptive parameter used for calculating the second derived factor when the calculated factor is less than the previously calculated factor by less than the selected amount;

(i) averaging means operably associated with said first and second means for calculating an averaged velocity dependent factor from a selected number of calculated and/or derived factors;

(j) error determining means operably associated with said averaging means for computing an error factor by comparing the averaged velocity factor with a target factor; and, (k) control means operably associated with said error determining means and with said adjusting means for causing regulation of the spacing between said work rolls in response to the error factor.

9. The mill of claim 8, wherein:

(a) said input means includes an input roll and said first tachometer means is operably associated with said input roll; and, (b) said output means includes an output roll and said third tachometer is operably associated with said output roll.

10. The mill of claim 9, wherein:

(a) said adjusting means includes screw drive means operably associated with one of said work rolls.

11. The mill of claim 8, wherein:

(a) said averaging means includes means for selecting the number of calculated and/or derived factors to be used in calculating said averaged factor.

12. The mill of claim 8, wherein:

(a) said first and second means velocity dependent factor includes the percentage extension of the material passing through said work rolls.

13. The mill of claim 8, wherein:

(a) said first derived factor is based upon the ratio of the apparent work roll velocity to the apparent output velocity; and, (b) said second derived factor is based upon the ratio of the apparent work roll velocity to the apparent input velocity.

14. The mill of claim 13, wherein:

(a) said first adaptive parameter is proportional to the ratio of the apparent input velocity to the apparent work roll velocity; and, (b) said second adaptive parameter is proportional to the ratio of the apparent output velocity to the apparent work roll velocity.

15. The method of controlling a velocity dependent factor of strip material being processed in a mill having an input assembly supplying material to be processed, spaced work rolls for processing the material, means for adjusting the spacing between the work rolls, and an output assembly for removing processed material, the method comprising the steps of:

(a) simultaneously determining the apparent velocity of material prior to, between and subsequent to the work rolls;

(b) determining input slip by comparing the apparent input Velocity with the apparent work roll velocity and determining output slip by comparing the apparent output velocity with the apparent work roll velocity;

(c) calculating a selected velocity dependent factor in response to a comparison of input slip with output slip;

(d) comparing the calculated factor with a previously calculated factor and calculating a derived factor when the calculated factor exceeds the previously calculated factor by more than a selected amount and calculating an adaptive factor used to calculate the derived factor when the calculated factor does not exceed the preceding calculated factor by the selected amount;

(e) averaging a selected number of the calculated and/or derived factors;

(f) determining the divergence between the averaged factor and a target factor; and, (g) adjusting the spacing between the work rolls in response to the divergence of the averaged factor with the target factor.

16. The method of claim 15, including the step of:

(a) calculating percentage extension of the material as said selected velocity dependent factor.

17. The method of claim 16, including the steps (a) calculating the percentage extension pursuant to the equation $En=(1-V1/V2)\ 100$ when input slip is not less than output slip; and, (b) calculating the percentage extension pursuant to the equation $En=(V2/V1-1)\ 100$ when the input slip is less than the output slip.

18. The method of claim 17, including the steps of:

(a) calculating the adaptive factor pursuant to the equation $\alpha=V1/Vs$ when input slip is not less than output slip and the calculated factor differs from the previous factor by less than 50%; and, (b) calculating the adaptive factor pursuant to the equation $\beta=V2/Vs$ when input slip is less than output slip and the calculated factor differs from the previous factor less than 50%.

19. The method of claim 17, including the step of:

(a) calculating the derived factor pursuant to the equation $En=(1-\alpha Vs/V2)$ when input slip is not less than output slip and the calculated factor exceeds the previous factor by more than 50%; and, (b) calculating the derived factor pursuant to the equation $En=(\beta Vs/V1-1)$ when input slip is less than output slip and the calculated factor exceeds the previous factor by more than 50%.

20. The method of claim 15, including the step of:

(a) varying the speed with which the work rolls are adjusted in response to the divergence of the averaged factor with the target factor.

21. The method of claim 15, including the step of:

(a) continuously adjusting the spacing between the work rolls so that at least one of the work rolls is substantially constantly in motion.

22. The method of claim 15, including the step of:

(a) randomly selecting the number of calculated and/or derived factors used to calculate the control for causing adjustment of the spacing between the work rolls.

23. The method of claim 20, including the step of:

(a) providing at least nine bands of control for causing adjustment of the spacing between the work rolls, each band of control varying the rate of adjustment of the work rolls.

24. The method of claim 15, including the step of:

(a) determining the apparent velocity with reference to a rotatable roll in contact with the material at each location used to provide a velocity value.

25. The method of claim 24, including the step of:

(a) operatively connecting a tachometer means with each of the rolls and generating the apparent velocity with the tachometer.

26. The method of claim 15, including the step of:

(a) assuring that a predetermined length of the material has passed through the work rolls prior to determining the apparent velocities.

27. The method of claim 15, including the step of:

(a) adjusting the spacing between the work regulating the force applied to one of the rolls in forcing the one roll toward the other.

28. The method of claim 15, including the step of:

(a) disregarding spurious velocity dependent factors.

29. Apparatus for regulating the operation of a rolling mill having a material input, opposed work rolls, means for adjusting the spacing between the work rolls, and a material output, the apparatus comprising:

(a) means for determining slip at the inlet and the outlet;

(b) means for calculating a velocity dependent factor based upon the velocity of the material at the output and the input;

(c) means for comparing the calculated factor with an aim factor;

(d) means for calculating a derived factor when the calculated factor exceeds a previously calculated factor by more than a selected amount and for calculating an adaptive factor used to calculate the derived factor when the calculated factor does not exceed the previously calculated factor by more than the selected amount;

(e) means for generating an averaged factor from a selected number of calculated and/or derived factors;

(f) means for determining the divergence of the averaged factor with an aim factor; and, (g) means for operably association with the adjusting means for causing regulation of the spacing between the work rolls in response to the divergence determined.

* * * * *